US006015260A

United States Patent [19]

Marichal

[11] Patent Number: 6,015,260

[45] Date of Patent: Jan. 18, 2000

[54] BLOW-OFF DEVICE OF A COMPRESSOR UNIT AND MOISTURE SEPARATOR USED THEREBY

[75] Inventor: Marc Leopold Karel Maria Marichal, Aartselaar, Belgium

[73] Assignee: Atlas Copco Airpower, naamloze vennootschap, Belgium

[21] Appl. No.: 09/047,376

[22] Filed: Mar. 25, 1998

[30] Foreign Application Priority Data

Mar. 25, 1997 [BE] Belgium ..... 9700263

[51] Int. Cl.[7] ..... F01B 31/18

[52] U.S. Cl. ..... 415/169.002; 415/169.004

[58] Field of Search ..... 415/169.2, 169.1, 415/169.4, 176, 177, 178; 417/313, 243, 297; 210/512.1, 304, 175, 180; 55/DIG. 7, 315, 447, 455, 456, 457, 434.2

[56] References Cited

U.S. PATENT DOCUMENTS

| | | | |
|---|---|---|---|
| 3,915,679 | 10/1975 | Roach et al. | 55/347 |
| 4,180,391 | 12/1979 | Perry, Jr. et al. | 55/324 |
| 4,270,885 | 6/1981 | Shaffer et al. | 417/279 |
| 5,287,916 | 2/1994 | Miller | 165/113 |
| 5,302,300 | 4/1994 | Porri . | |

FOREIGN PATENT DOCUMENTS

| | | |
|---|---|---|
| 0 064 739 | 5/1982 | European Pat. Off. . |
| 0 172 430 | 7/1985 | European Pat. Off. . |
| 2 691 382 | 11/1993 | France . |
| WO 83/01491 | 4/1983 | WIPO . |

*Primary Examiner*—Edward K. Look
*Assistant Examiner*—Ninh Nguyen
*Attorney, Agent, or Firm*—Bacon & Thomas PLLC

[57] ABSTRACT

Blow-off device of a compressor unit, which compressor unit is of the type comprising a compressor (1) to which an outlet conduit (4) is connected with therein a cooler (5) with a moisture separator (6) and a return valve (7), whereby the blow-off device (8) comprises a blow-off conduit (9) which, on one hand, is connected to the outlet conduit (4) between the cooler (5) and the return valve (7) and, on the other hand, gives out into the atmosphere, and a blow-off valve (10) which is arranged in this blow-off conduit (9), wherein the blow-off device (8) comprises a moisture separator (11) which is placed in the blow-off conduit (9) between the outlet conduit (4) and the blow-off valve (10) and comprises means (15–16) for subjecting the blown-off fluid to a turbulence, such that moisture is separated.

12 Claims, 2 Drawing Sheets

1
2
3
4
5
6
7
8
9
9A
9B
10
11
12
13
14
15
16
17
18
19
F2

BLOW-OFF DEVICE OF A COMPRESSOR UNIT AND MOISTURE SEPARATOR USED THEREBY

BACKGROUND OF THE INVENTION

A) Field of the Invention

This invention relates to a blow-off device of a compressor unit, which compressor unit is of the type comprising a compressor to which an outlet conduit is connected with therein a cooler with a moisture separator and a return valve, whereby the blow-off device comprises a blow-off conduit which, on one hand, is connected to the outlet conduit between the cooler and the return valve and, on the other hand, gives out into the atmosphere, and a blow-off valve which is arranged in this blow-off conduit.

B) Related Art

In the known compressor units, an inlet conduit in which a closing valve is provided is connected to the compressor, to which the blow-off valve is coupled in such a manner that, when the closing valve in the inlet conduit is open, respectively closed, the blow-off valve closes, respectively opens, the blow-off conduit.

When this compressor switches from loaded running to unloaded running, the closing valve in the inlet conduit is closed, and consequently the blow-off valve in the blow-off conduit is opened.

The compressed air which is present, among others, in the compressor, in the part of the outlet conduit which is situated between this compressor and the blow-off conduit, and the blow-off conduit itself, suddenly is relieved.

As a result of this sudden and short relief and expansion of the compressed air, the temperature of the compressed air will decrease suddenly and moisture present in the compressed air will condense.

Also, free water from the moisture separator of the cooler will be entrained.

The blown-off compressed air, thus, will comprise moisture particles which are hurled against the housing and other parts of the compressor unit, which causes rust formation and dirt accumulation and is disadvantageous for their service life.

This disadvantage first of all becomes obvious when the compressor is working in humid conditions.

BRIEF SUMMARY OF THE INVENTION

This invention aims at a compressor unit which does not show this disadvantage and other disadvantages and whereby no moisture particles are entrained with the blown-off air.

According to the invention, this aim is achieved in that the blow-off device comprises a moisture separator which is arranged in the blow-off conduit between the outlet conduit and the blow-off valve and comprises means to subject the blown-off fluid to a turbulence, such that moisture is separated.

Preferably, the means for creating a turbulence comprise a vortex element which is provided with openings providing a passage to a turbulence chamber, whereby this turbulence chamber is provided with an outlet which extends through the vortex element but is separated from the aforementioned openings.

In the turbulence chamber, a deflector may be placed opposite to the openings of the vortex element.

The water separator may be provided in a vertical part of the blow-off conduit, in which case the aforementioned turbulence chamber is oblong and extends more or less in horizontal direction.

Preferably, the moisture separator of the blow-off device also comprises means for inducing the flow direction of the fluid in the blow-off conduit to change.

This moisture separator may comprise a head, in which case the aforementioned means for changing the flow direction can be formed by partitions dividing this head into an inlet chamber which gives out on the means for creating a turbulence, and an outlet chamber.

This invention also relates to a moisture separator which is destined for use in the blow-off device according to any of the preceding forms of embodiment.

BRIEF DESCRIPTION OF THE DRAWINGS

With the intention of better showing the characteristics of the invention, hereafter, as an example without any limitative character, several preferred forms of embodiment of a blow-off device and of a moisture separator used therewith according to the invention are described, with reference to the accompanying drawings, wherein.

DETAILED DESCRIPTION

Figure 1:
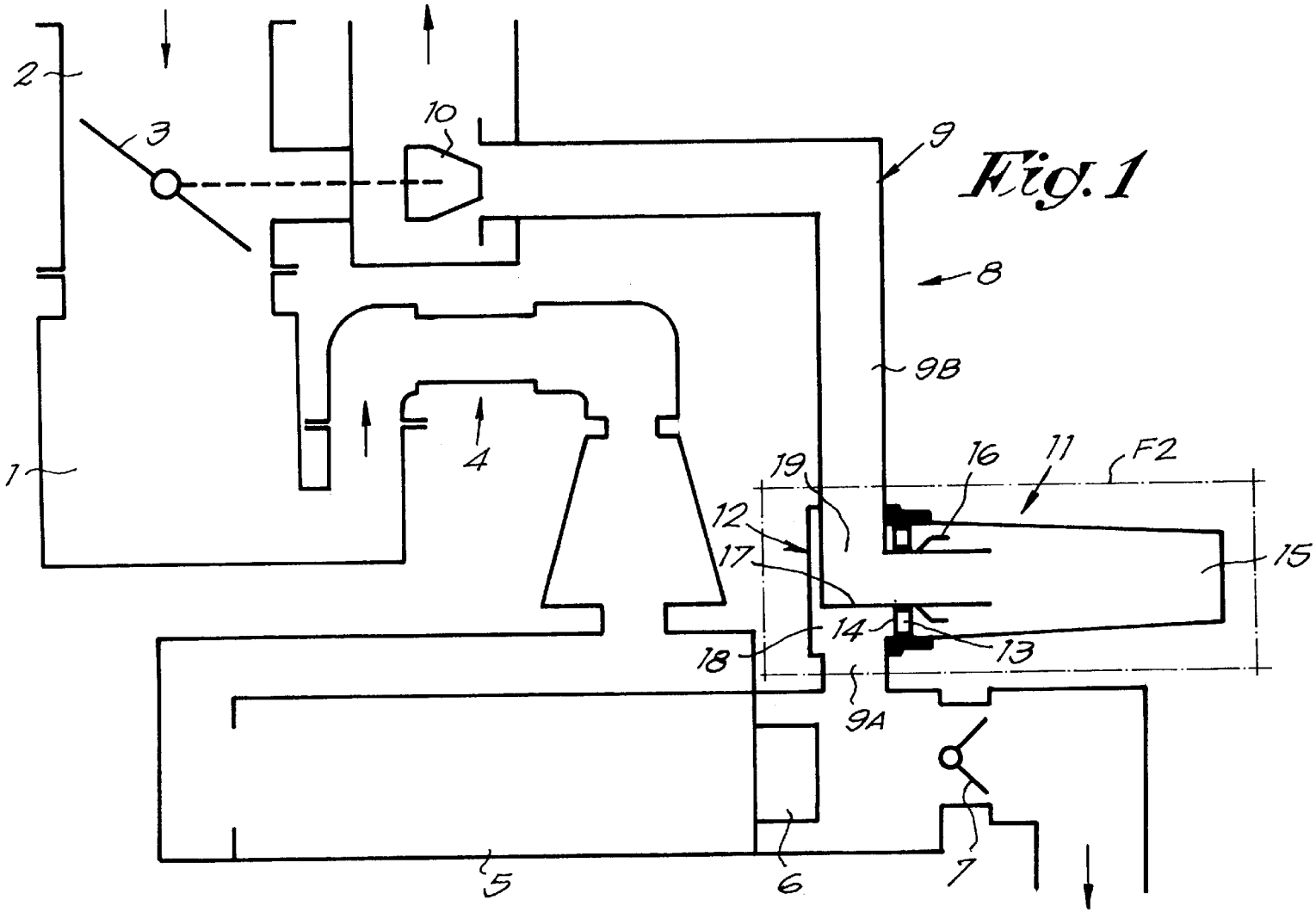
FIG. 1 schematically and in cross-section represents a compressor unit, provided with a blow-off device according to the invention.

The compressor unit, as represented in FIG. 1, substantially consists of a compressor 1 to which, on one hand, an inlet conduit 2 is connected in which a closing valve 3 is arranged, and, on the other hand, an outlet conduit 4 is connected in which, successively, a cooler 5 provided with a moisture separator 6 and a return valve 7 are arranged, whereas a blow-off device 8 is connected to the outlet conduit 4.

Thereby, the blow-off device 8 is formed of a blow-off conduit 9 which, with one extremity, is connected to a portion of the outlet conduit 4 situated between the moisture separator 6 and the return valve 7, and, with its other extremity, gives out into the atmosphere, of a return valve 10 which is arranged at the second-mentioned extremity of the blow-off conduit 9, and of a moisture separator 11 which is situated in the blow-off conduit 9 between the outlet conduit 4 and the blow-off valve 10.

The blow-off valve 10 is coupled mechanically to the closing valve 3 in the in let conduit 2, in such a manner that, when this closing valve 3 opens or closes, the blow-off vlave 10 closes, respectively opens, the blow-off conduit 9.

The cooler 5 is situated lower than the compressor 1, whereas the blow-off valve 10 is situated at the height of the inlet conduit 2 connected to the top side of the compressor 1, as a result of which the blow-off conduit 9 for a major part extends vertically. The moisture separator 11 is present in this vertical part.

This moisture separator 11 is based upon the cyclone principle and consists of a head 12 which, by means of openings 13, directed in an inclined manner, of a vortex element 14 gives out to an oblong turbulence chamber 15 which, with its longitudinal direction, is arranged horizontally and in which a deflector 16 is arranged opposite to the vortex element 14.

By means of partitions 17, the aforementioned head 12 is divided into two separate chambers 18 and 19, whereby one chamber thereof forms an inlet chamber 18, to which the lower part 9A of the blow-off conduit 9 gives out and which, by means of the vortex element 14, is in connection with the turbulence chamber 15, whereas the other chamber forms a central outlet chamber 19 which extends through the chamber 18, is connected, by means of the vortex element 14, to the turbulence chamber 15 and is connected to the upper part 9B of the blow-off conduit 9.

The partitions 17 form means in order to change the direction of the air flow in the blow-off conduit 9 towards the turbulence chamber 15, respectively from this chamber 15 to the blow-off conduit 9, whereas the vortex element 14, in particular together with the deflector 16, forms means for giving a turbulence to this blow-off air.

The function of the blow-off device 8 described heretofore is as follows.

When the compressor 1 switches from loaded condition to unloaded condition, the closing valve 3 in the inlet conduit 2 is closed. By means of the coupling of this closing valve 3 with the blow-off valve 10, this latter is opened.

Consequently, in a short period of time compressed air, saturated with condensation water and free water, will escape from outlet conduit 4 by means of the blow-off device 8.

As a result of the pressure decrease in the outlet conduit 4, the return valve 7 will close immediately.

The aforementioned compressed air or blow-off air is forced to flow over the moisture separator 11 in which it is forced by the partitions 17 of the head 12 to change its direction and is directed through the openings 13 in the vortex element 14 into the turbulence chamber 15, whereby this blow-off air in this turbulence chamber 15 bounces against the deflector 16.

As a consequence of the change in the direction of the blow-off air in the head 12 and the turbulence created by the vortex element 14 and the deflector 16, water will be separated from this blow-off air.

This water is collected in the turbulence chamber 15. When the blowing-off is finished and the compressor 1 works further unloaded, this water flows beneath, through one of said openings 13 or through a special drain opening 20 in the vortex element 14, out of the turbulence chamber 15 back to the inlet chamber 18 of the head 12 and from there further on to the moisture separator 6.

The air of which the moisture has been separated leaves the turbulence chamber 15 through the opening with which the outlet chamber 19 of the head 12 gives out in this chamber and in this manner flows further through the part 9B of the blow-off conduit, through the open blow-off valve 10, into the atmosphere.

This air, which is blown off through the blow-off conduit 9 in this manner, thus practically does not contain any liquid, and the parts of the compressor unit exposed to environmental air thus will not become wet as a result of moisture condensation in the blow-off air.

When the compressor is working under load, the closing valve 3 is open and the blow-off valve 10 therefore is closed. Then, no air will flow through the blow-off device 8. Water which then eventually still is present in the part 9B of the blow-off conduit 9 or in the turbulence chamber 15, can flow back to the inlet chamber 18 and further on to the moisture separator 6 which connects to the cooler 5.

Figure 2:
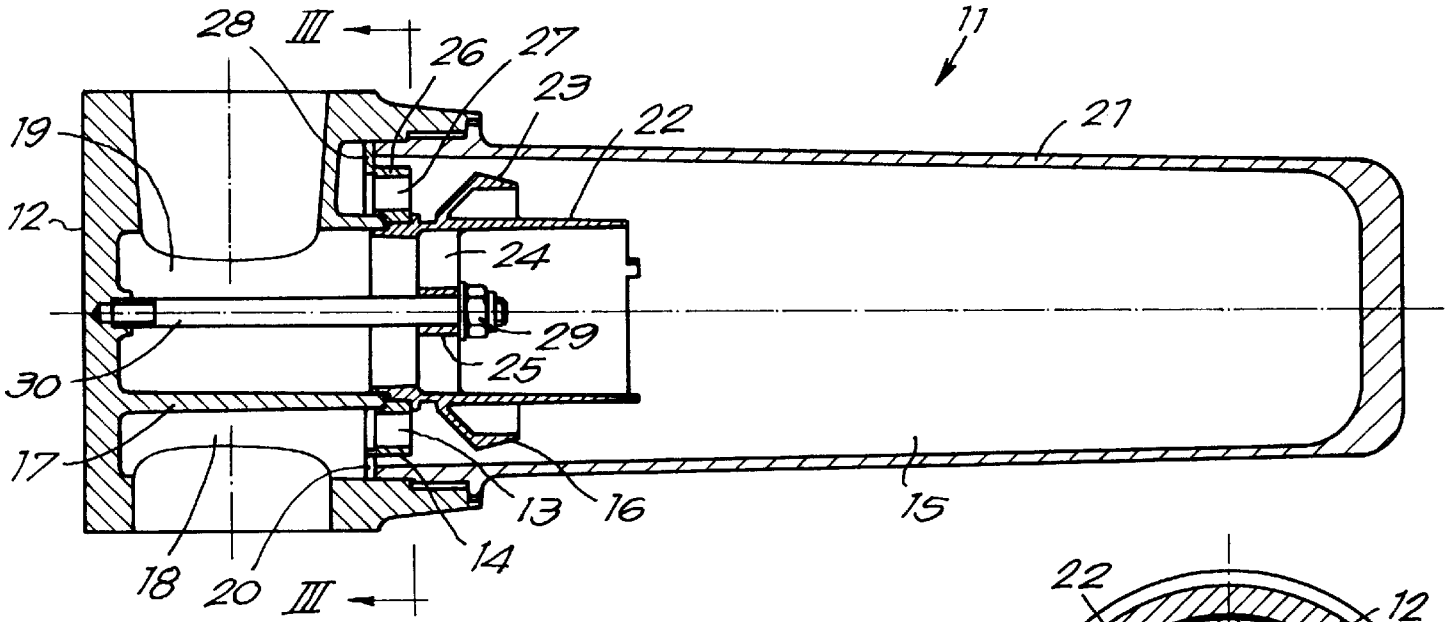
FIG. 2, at a larger scale and in detail, represents a practical form of embodiment of the part which is indicated by F2 in FIG. 1.
Figure 3:
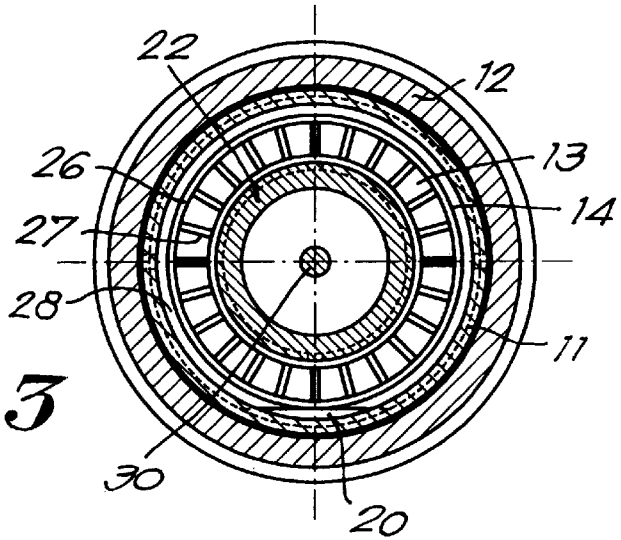
FIG. 3 represents a cross-section according to the line III—III in FIG. 2.

In FIGS. 2 and 3, a practical form of embodiment of the moisture separator 11 of the blow-off device 8 is represented.

The turbulence chamber 15 is bordered by a container 21 which is screwed onto the head 12 which, by the partitions 17, is divided into an inlet chamber 18 and an outlet chamber 19.

The deflector 16 consists of a central, tubular part 22 giving out to the outlet chamber 19, and a collar 23 connected to this part 22 and directed in an inclined manner away from this part 22 and from the head 12. By means of this tubular part 22, the inside of the cup-shaped element 21 is in connection with the outlet chamber 19.

At its inside, the tubular part 22 is connected by means of partition elements 24 to a central round part 25 for fixation.

The vortex element 14 consists of a short ring-shaped tubular element 26 which surrounds the tubular part 22 of the deflector 16 and, by partition elements 27, is divided into channels forming said openings 13, and of a collar 28 connected to the exterior of the tubular element 26.

The partition elements 27 are directed radially, but inclined in respect to the longitudinal axis of the turbulence chamber 15, such that the air flowing through it obtains a whirling movement or vortex.

Beneath, the collar 28 is cut off, as represented in FIG. 3.

Said collar 23 of the deflector 16 is situated in the cup-shaped element 21 opposite to these openings 13, but has such dimensions that the passage from these openings 13 to the inside of the cup-shaped element 21 is not completely closed off.

The deflector 16 is fixed against the vortex element 14 and pushes this vortex element against the partitions 17 of the head 12, by means of a nut 29 which is screwed onto a rod 30 which extends loosely through the central part 25 of the deflector 16 and is screwed into the wall of the head 12.

The collar 28 of the vortex element 14 closes off the opening between the cup-shaped element 21 and the tubular element 26, with the exception of the bottom side, where, as a result of the cutting away, said special drain opening 20 is formed for the flowing back of the water collected in the cup-shaped element 21 to the inlet chamber 18 of the head 12.

The working is analogous as described heretofore.

The present invention is in no way limited to the forms of embodiment described heretofore and represented in the drawings hereto attached, on the contrary may such blow-off device and moisture separator be realized in various variants without leaving the scope of the invention.

It is claimed:

1. A blow-off device of a compressor unit, which compressor unit is of the type comprising a compressor to which an outlet conduit is connected with therein a cooler with a moisture separator and a return valve, whereby the blow-off device comprises a blow-off conduit which, on one hand, is connected to the outlet conduit between the cooler and the return valve and, on the other hand, gives out into the atmosphere, a blow-off valve which is arranged in this blow-off conduit, and a moisture separator which is placed in the blow-off conduit between the outlet conduit and the blow-off valve and comprises means for subjecting the blown-off fluid to a turbulence, such that moisture is separated.

2. The blow-off device according to claim 1, wherein the means for creating a turbulence comprise a vortex element which is provided with openings which provide admission to a turbulence chamber which is provided with an outlet which extends through the vortex element but is separated from said openings.

3. The blow-off device according to claim 2, wherein a deflector is placed in the turbulence chamber, opposite to the openings of the vortex element.

4. The blow-off device according to claim 2, wherein the vortex element comprises a ring-shaped tubular element which, by means of partition elements, is divided into channels forming said openings.

5. The blow-off device according to claim 2, wherein the vortex element has a ring-shaped tubular element divided into channels by partition elements, and a collar which connects to the exterior of said ring-shaped tubular element and is cut off at the bottom side, such that beneath a drain opening is formed between the vortex element and the turbulence chamber through which moisture collected in this turbulence chamber can flow off.

6. The blow-off device according to claim 2, wherein that it comprises a deflector in the turbulence chamber, and the vortex element comprises a ring-shaped tubular element divided into channels by partition elements, said deflector having a tubular part through which said outlet of the turbulence chamber extends and which is surrounded by the ring-shaped tubular element and a collar, standing on the outside of its tubular part, which is situated opposite to the openings.

7. The blow-off device according to claim 2, wherein the moisture separator is arranged in a vertical part of the blow-off conduit, and the turbulence chamber is oblong and extends more or less in horizontal direction.

8. The blow-off device according to claim 1, wherein its moisture separator also comprises means for inducing the flow direction of the fluid in the blow-off conduit to change.

9. The blow-off device according to claim 8, wherein the moisture separator comprises a head and said means for changing the flow direction are formed by partitions dividing this head into an inlet chamber giving out to the means for creating a turbulence, and an outlet chamber.

10. The blow-off device according to claim 8, wherein the moisture separator comprises a head divided by partitions into an inlet chamber and an outlet chamber, whereby the inlet chamber gives out to the turbulence chamber, whereas the outlet chamber connects with the outlet of this turbulence chamber.

11. The blow-off device according to claim 2, wherein the moisture separator comprises a head divided by partitions into an inlet chamber and an outlet chamber, and the turbulence chamber is bordered by a cup-shaped element fixed onto the head.

12. The moisture separator from the blow-off device according to claim 1.

* * * * *